US006085464A

United States Patent [19]

Lee

[11] Patent Number: 6,085,464

[45] Date of Patent: Jul. 11, 2000

[54] OPENING AND CLOSING APPARATUS OF FOLDING TYPE

[75] Inventor: Jang-Woo Lee, Seoul, Rep. of Korea

[73] Assignee: Hang Sang Industrial Co., Ltd., Chungcheongbuk-Do, Rep. of Korea

[21] Appl. No.: 09/352,655

[22] Filed: Jul. 6, 1999

[30] Foreign Application Priority Data

Jul. 7, 1998 [KR] Rep. of Korea ..... 98-27202

[51] Int. Cl.[7] ..... E05D 15/28

[52] U.S. Cl. ..... 49/246

[58] Field of Search ..... 49/246, 247, 248, 49/250, 251, 252; 16/93 R

[56] References Cited

U.S. PATENT DOCUMENTS

| | | | |
|---|---|---|---|
| 4,226,002 | 10/1980 | Davis | 49/248 X |
| 4,622,715 | 11/1986 | Buckley | 49/252 X |
| 4,833,754 | 5/1989 | Yang | 49/251 X |
| 4,980,947 | 1/1991 | McQuigge | 49/252 X |
| 5,040,267 | 8/1991 | Dallimann | 49/252 X |
| 5,074,075 | 12/1991 | La See | 49/252 |
| 5,083,344 | 1/1992 | Pettit et al. | 49/252 X |
| 5,255,471 | 10/1993 | Shaw et al. | 49/252 |
| 5,491,930 | 2/1996 | LaSee | 49/252 |

FOREIGN PATENT DOCUMENTS

| | | | |
|---|---|---|---|
| 8-177303 | of 1996 | Japan | 15/30 |
| 1133211 | 11/1968 | United Kingdom . | |
| 2022669 | 12/1979 | United Kingdom | 49/248 |
| 2 275 304 | 8/1994 | United Kingdom | 5/12 |

*Primary Examiner*—Jerry Redman

*Attorney, Agent, or Firm*—Hamilton, Brook, Smith & Reynolds, PC

[57] ABSTRACT

An opening and closing apparatus of the folding type includes a guiding part, a slider, a first link, and a second link. The guiding part has a guiding protrusion and a guiding bend for longitudinal movement of the slider therein and is fixed on a frame. One side of the first link is hinged to the lower side of the guiding part. The other side of the first link is hinged to the link-connecting portion of the second link. Centering about the link-connecting portion, one side of the second link is hinged with a movable frame and the other side thereof is connected with a rotating part of the slider. The slider has friction-reducing portions to prevent the slider from frictional wear with the guiding protrusion, the guiding bend, and the slider connecting portion. The slider has a locking protrusion for maintaining the apparatus in a closed state.

27 Claims, 8 Drawing Sheets

OPENING AND CLOSING APPARATUS OF FOLDING TYPE

BACKGROUND OF THE INVENTION

1. Field of the Invention

The present invention relates to an opening and closing apparatus, more particularly to an opening and closing apparatus of the folding type which opens and closes windows by moving a slider along with a guiding part according to a movement of two links hinged connected with each other.

2. Prior Art

Generally, an opening and closing apparatus of the folding type achieves an opened state by moving a movable frame apart from a fixed frame and a closed state by moving the movable frame toward the fixed frame. The opening and closing apparatus of the folding type can be employed with a top cover of a convertible automobile or windows.

The conventional opening and closing apparatus of the folding type includes a guide rail fixed on the fixed frame and links hinged on the guide rail. Each link is folded over the guide rail.

The conventional opening and closing apparatus as constructed above is described in detail according to the accompanying drawings.

FIG. 1 depicts the conventional opening and closing apparatus. As shown in FIG. 1, the conventional opening and closing apparatus includes a guide rail A, a first link B, a slider C, a second link D, a third link E, and a fourth link F. The guide rail A is secured at a fixed frame (not shown). One side of the first link B is hinged on an upper side of the guide rail A and the other side of the first link B is hinged on a predetermined position of the fourth link F. The slider C is inserted into the guide rail A to move along with the guide rail A. One side of the second link D is hinged on a predetermined position of the first link B and the other side of the second link D is hinged on the slider C. One side of the third link E is hinged on the slider C, and the other side of the third link E is hinged on the fourth link F. One side of the fourth link F is connected to a movable frame (not shown). A stopper G installed at the lower end of the guide rail A engages the fourth link F when the conventional opening and closing apparatus is moved into the closed state.

Hereinafter, the operation of the conventional opening and closing apparatus will be described.

When the movable frame is moved apart from the fixed frame, the fourth link F rotates about the stopper G in a clockwise direction. The first link B rotates about the guide rail A in a counterclockwise direction. At that time, the second link D is rotated about a position hinged with the first link B in a clockwise direction, and thus the slider C moves upwardly along the guide rail A. Therefore, the third link E connected with the slider C rotates about the slider C in a counterclockwise direction. As a result, the movable frame moves apart from the fixed frame in a predetermined angle and achieves an open state.

Contrarily, when the movable frame is pulled toward the fixed frame to achieve a closed state, the fourth link F rotates about the third link E in a counterclockwise direction. At that time, the first link B rotates about the guide rail A in a clockwise direction, and thus the second link D rotates about the slider C in a counterclockwise direction. The slider C moves downwardly along the guide rail A, and thus the third link E rotates in a clockwise direction until the lower end of the fourth link F is stopped by the stopper G. As a result, the first link B to the fourth link F lie one upon another, and thus the closed state is achieved.

A drawback with the conventional opening and closing apparatus of the folding type is that the slider C experiences wear from repeated opening and closing which causes unwanted movement in the guide rail A.

In addition, the conventional opening and closing apparatus of the folding type also generates noise caused by friction between the guide rail A and the slider C as well as friction between the construction members thereof at hinged positions.

Furthermore, the conventional opening and closing apparatus of the folding type has difficulty remaining in the closed state because of the abrasion due to the friction between the construction members at hinged connection parts.

SUMMARY OF THE INVENTION

The present invention is proposed to solve the above problems of the conventional opening and closing apparatus of the folding type. It is a first object of the present invention to provide an opening and closing apparatus of the folding type which prevents the slider from joggling in the guiding part when the slider moves along with the guiding part fixed on the fixed frame. It is a second object of the present invention to provide an opening and closing apparatus of the folding type which prevents the apparatus from generating noise caused by the friction between the construction members therebetween. It is a third object of the present invention to provide an opening and closing apparatus of the folding type which can remain in the closed state.

In order to achieve the above objects, an opening and closing apparatus of the folding type according to the present invention includes a guiding part having a guiding protrusion formed in a longitudinal direction on one side of the guiding part, a guiding bend formed in parallel to the guiding protrusion and having a shape of a C, and a first connecting portion formed on a lower side of the guiding part. A slider is slidably connected with the guiding protrusion and the guiding bend for moving along the longitudinal direction of the guiding part. A first link has a second connecting portion hinged with the first connecting portion and a third connecting portion formed at an opposite side from the second connecting portion. A frame connecting part has a link-connecting portion connected with the third connecting portion, a slider connecting portion is slanted to the slider side centered about the link-connecting portion, and a frame connecting portion formed at an opposite side from the slider connecting portion centered about the link-connecting portion.

In preferred embodiments, the guiding bend further includes at least one stopper formed at a lower side of the guiding bend and protruding inside of the guiding bend.

The guiding part further includes a first fixing portion which protrudes from a face between the guiding protrusion and the guiding bend and a second fixing portion which protrudes at an upper side of the first fixing portion.

The slider includes a rotating part having a connecting hole to be hinged with the second connecting portion of the first link; a combining part inserted into the guiding bend to combine with the guiding bend and for moving it along the guiding bend; a slant formed at one side of the combining part along a slope; a sliding part having a groove for receiving the guiding protrusion, a first leading portion having a stairstep formation with the combining part to receive the first fixing portion, and a second leading portion having a stairstep formation with the first leading portion to receive the second leading portion and continues from the groove; and a locking part formed at a rear side of the sliding part and having a stepped projection to receive the guiding bend when the slider moves toward a shutting position.

The rotating part includes at least one first friction reducing portion formed around the connecting hole to reduce friction forces between the slider and the second link when the rotating part cooperates with the second link.

The combining part includes a second friction reducing portion for reducing friction forces between the guiding bend and the combining part when the combining part connects with the guiding bend and moves along the guiding part. Ripples are formed on a wall of the groove.

The locking part further includes a locking protrusion protruding from the locking part toward the second link and having a dome shape. The second link includes a fixing protrusion protruding toward the locking protrusion to face each other and having a dome shape.

The slider is made of plastic and includes a reinforcing member made of metal which is inserted on the inside of the slider.

The reinforcing member includes a first reinforcing piece protruding from one face of the reinforcing member facing the combining part to reinforce the slider and a second reinforcing piece protruding from the opposite side of the first reinforcing piece to reinforce the combining part.

The present invention opening and closing apparatus prevents the slider from joggling in the guiding part by moving the slider having the rotating part and the groove along the guiding part.

Second, the slider has a friction reducing portion formed on each of the combining part, the groove, and the rotating part, which suppresses noise caused by the frictional operation between the components by putting oil into or on the frictional portion.

Third, the guiding part having the first and second fixing portions, the slider having the first and second leading portions, the locking protrusion, and the fixing protrusion, together, stably maintain the apparatus in the closed state.

Fourth, the reinforcing member having the first reinforcing piece and the second reinforcing piece is made of metal and provides the slider with more rigidity. Even though the plastic slider will melt in a fire, the metal reinforcing member will not melt, thereby keeping the opening and closing apparatus together and preventing secondary accidents caused by falling of the movable frame.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. This invention will be better understood and its various objects and advantages will be more fully appreciated from the following description taken in conjunction with the accompanying drawings, in which.

DETAILED DESCRIPTION OF THE INVENTION

Preferred embodiments of the present invention will be illustrated below with reference to the accompanying drawings.

Figure 1:
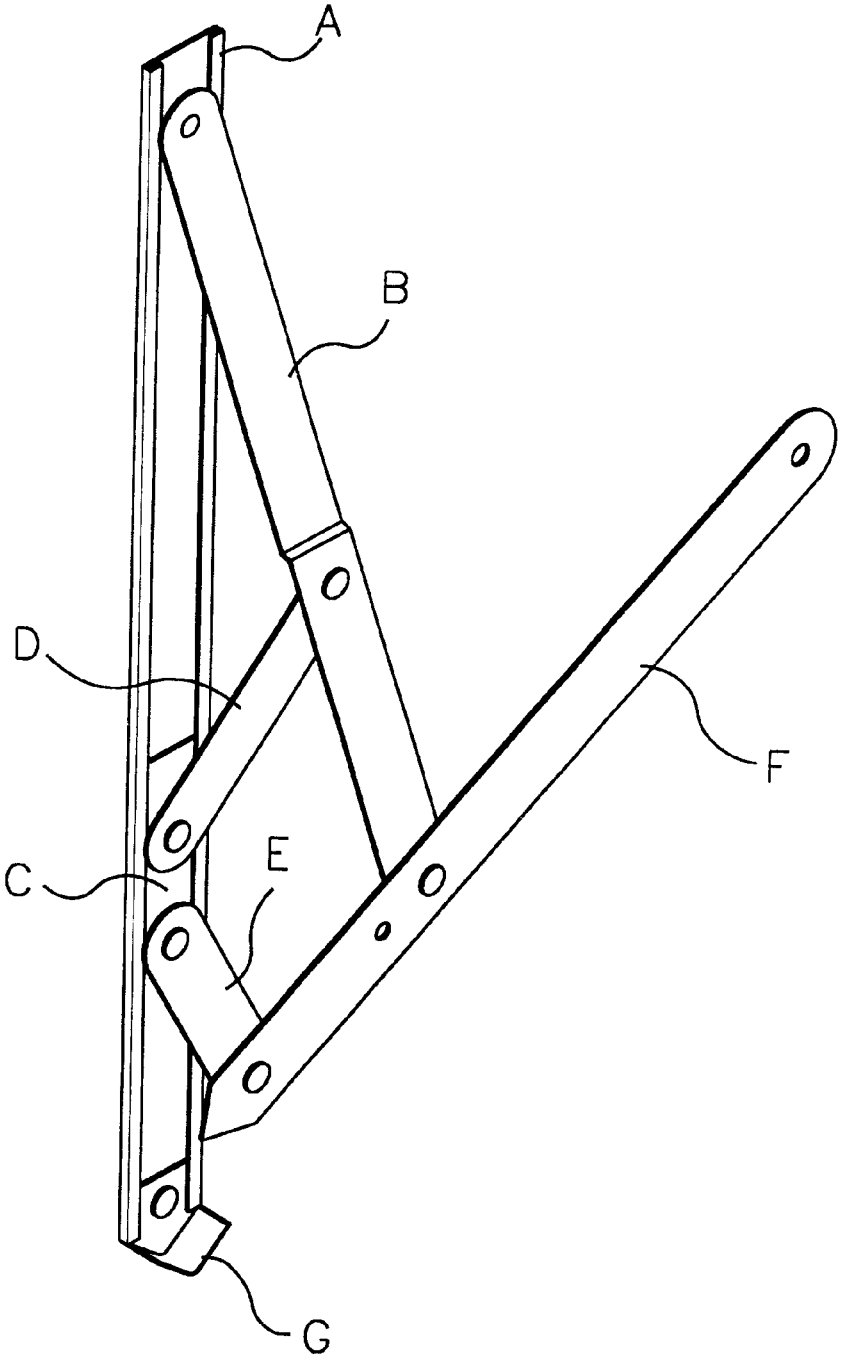
FIG. 1 PRIOR ART
FIG. 1 is a perspective view for showing a conventional opening and closing apparatus of the folding type.
Figure 2:
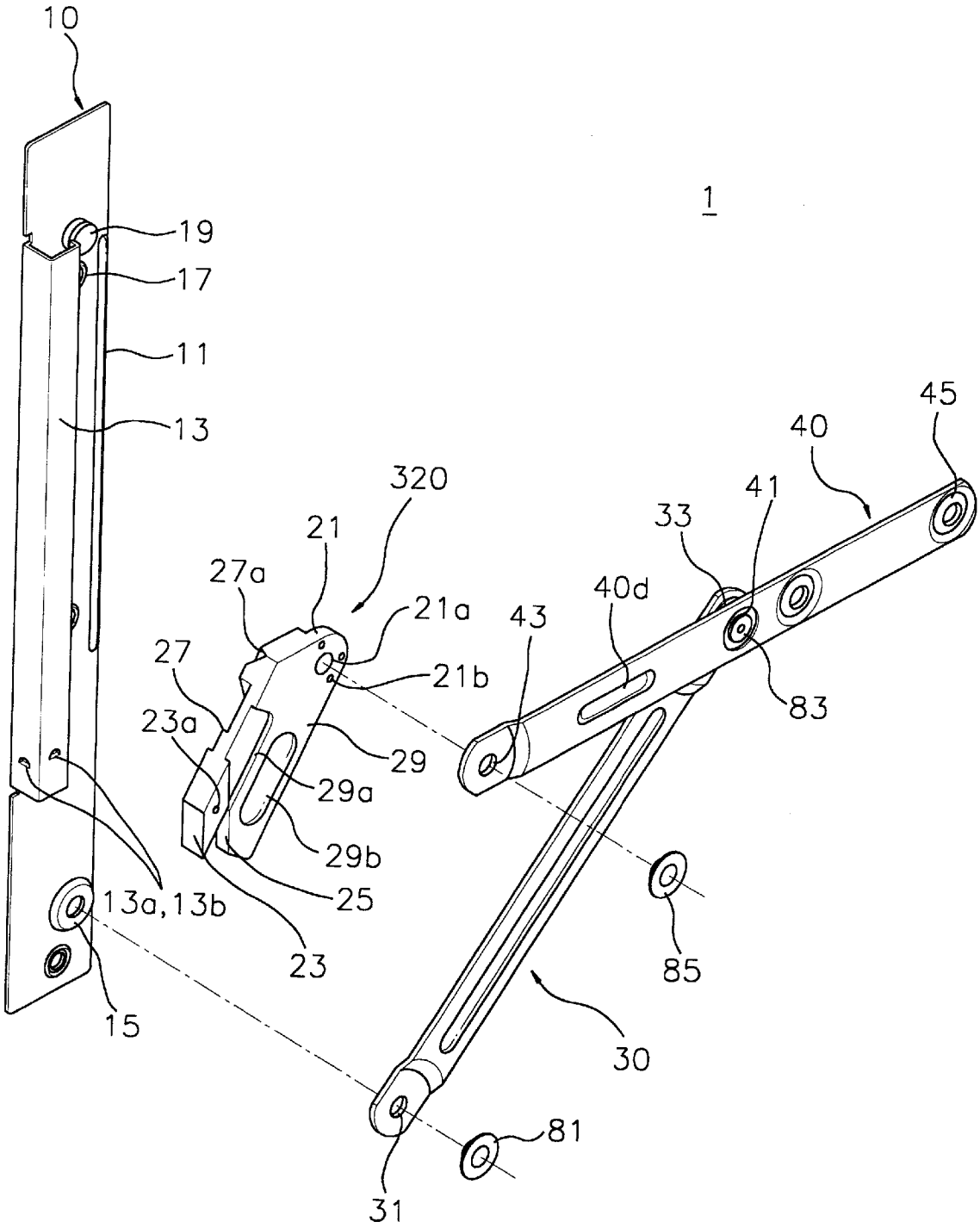
FIG. 2 is a perspective view for showing an opening and closing apparatus of the folding type according to the present invention.
Figure 3:
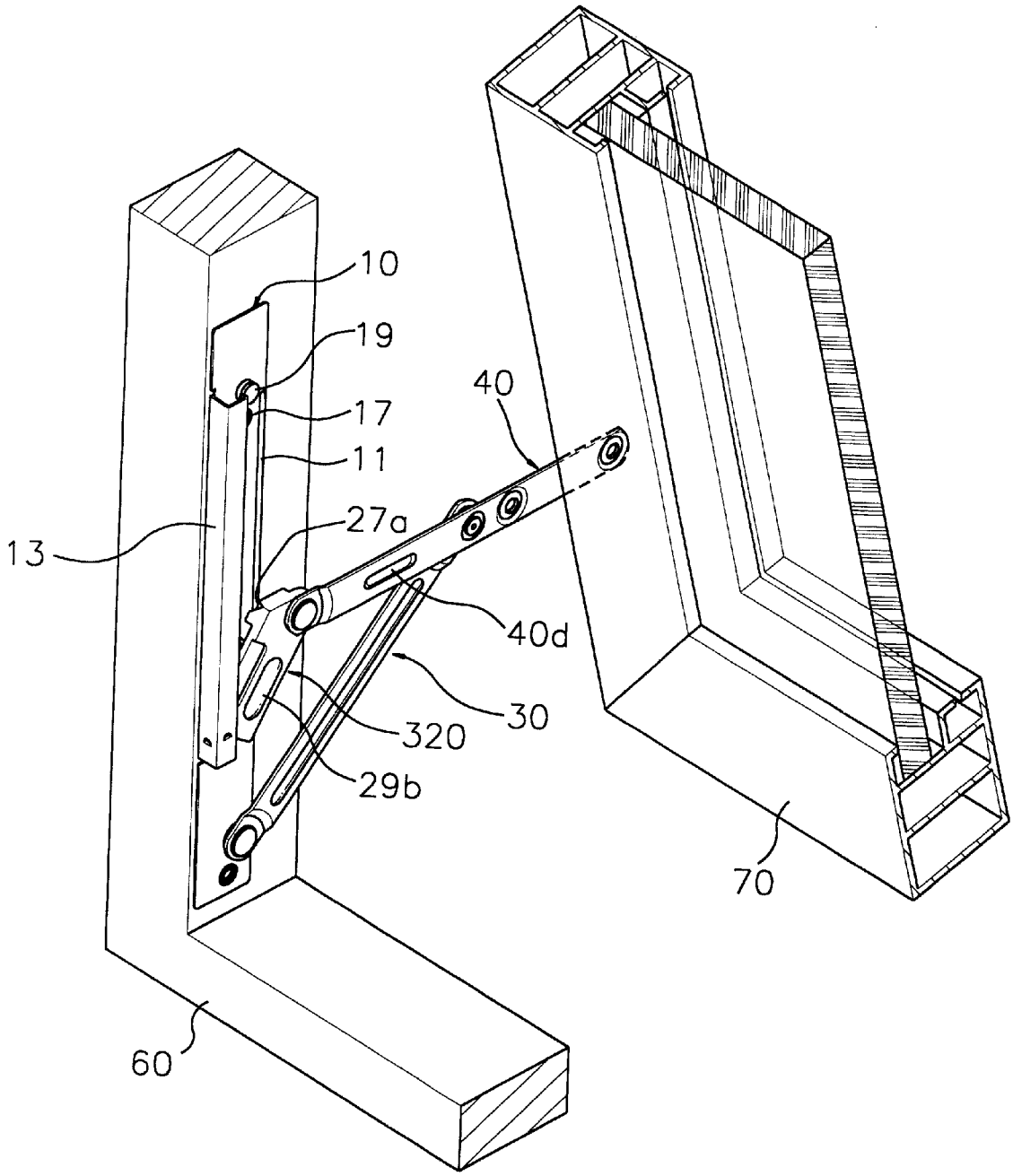
FIG. 3 is a perspective view for showing the established state of the opening and closing apparatus of the folding type according to the present invention.
Figure 4A:
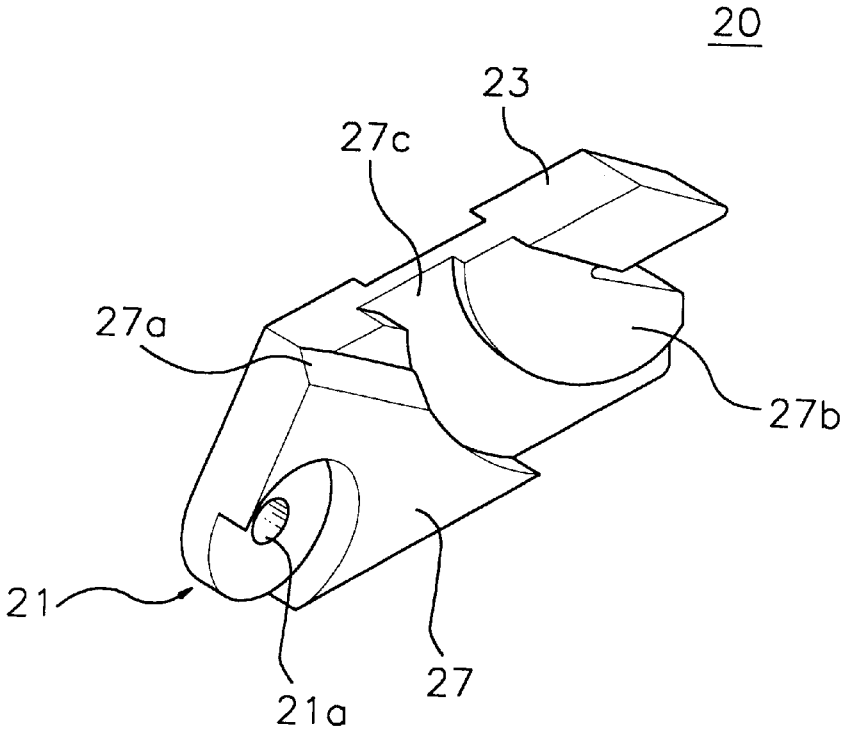
FIG. 4A is a perspective view for showing a sliding part of a slider according to the first embodiment of the present invention.
Figure 4B:
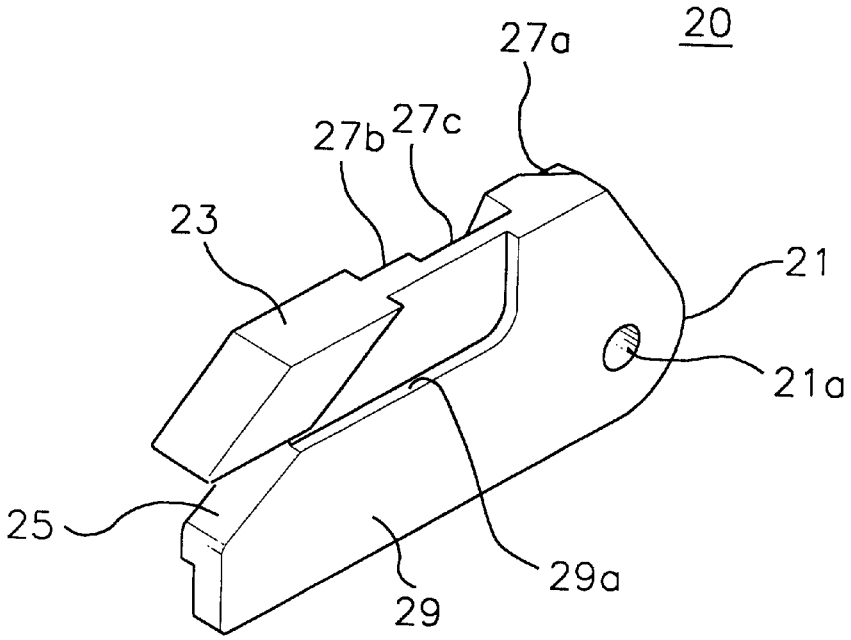
FIG. 4B is a perspective view for showing a locking part of the slider according to the first embodiment of the present invention.
Figure 5A:
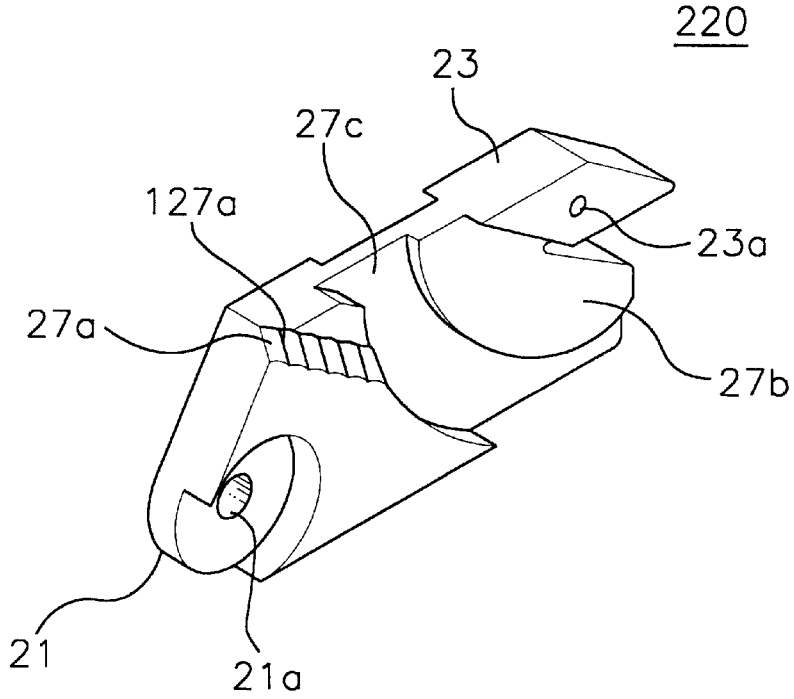
FIG. 5A is a perspective view for showing a sliding part of a slider according to the second embodiment of the present invention.
Figure 5B:
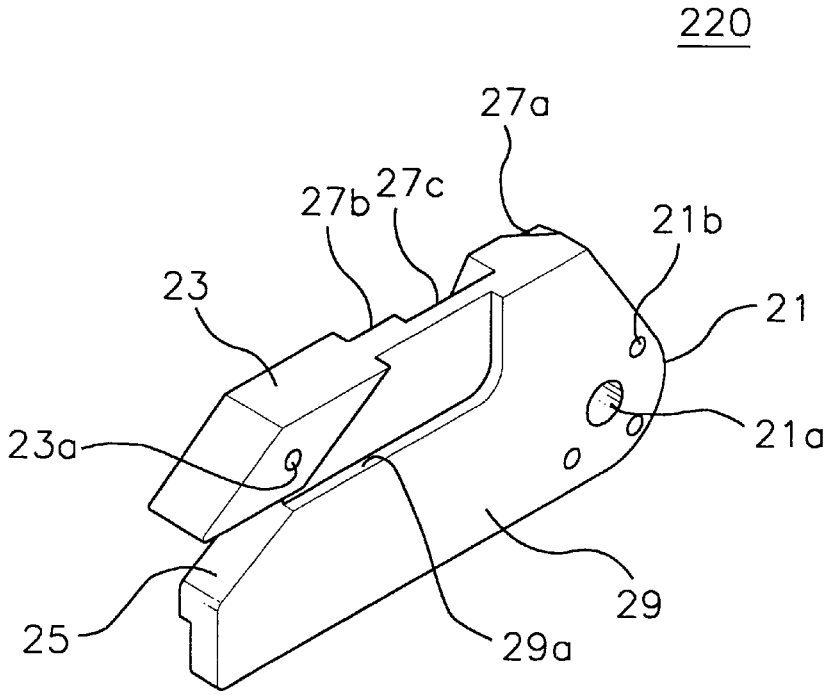
FIG. 5B is a perspective view for showing a locking part of the slider according to the second embodiment of the present invention.
Figure 6A:
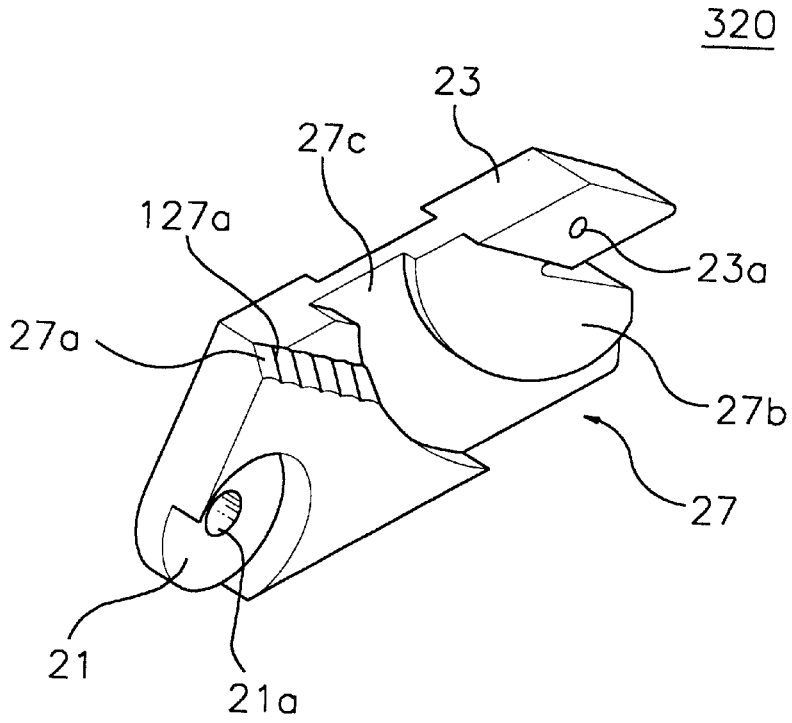
FIG. 6A is a perspective view for showing a sliding part of a slider according to the third embodiment of the present invention.
Figure 6B:
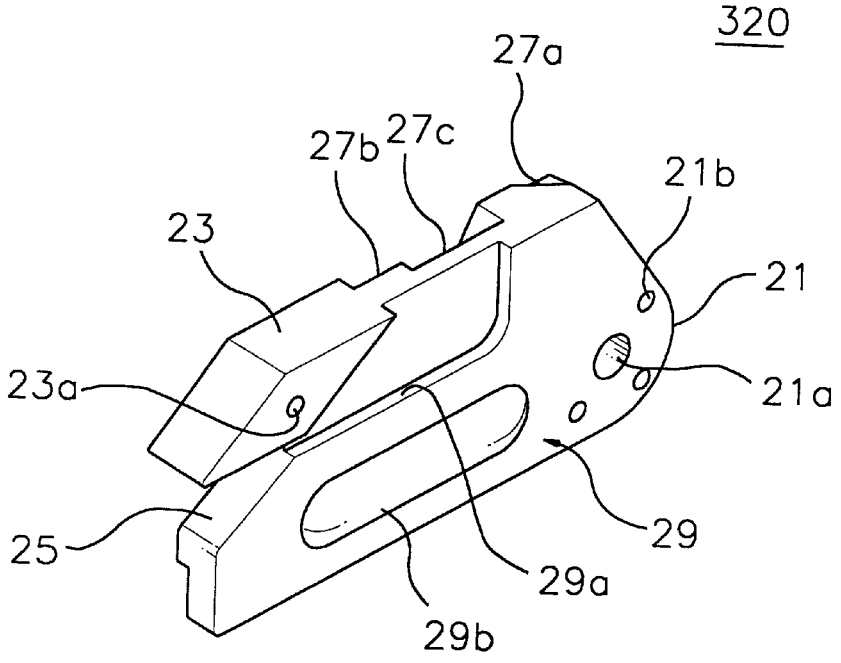
FIG. 6B is a perspective view for showing a locking part of the slider according to the third embodiment of the present invention.
Figure 7A:
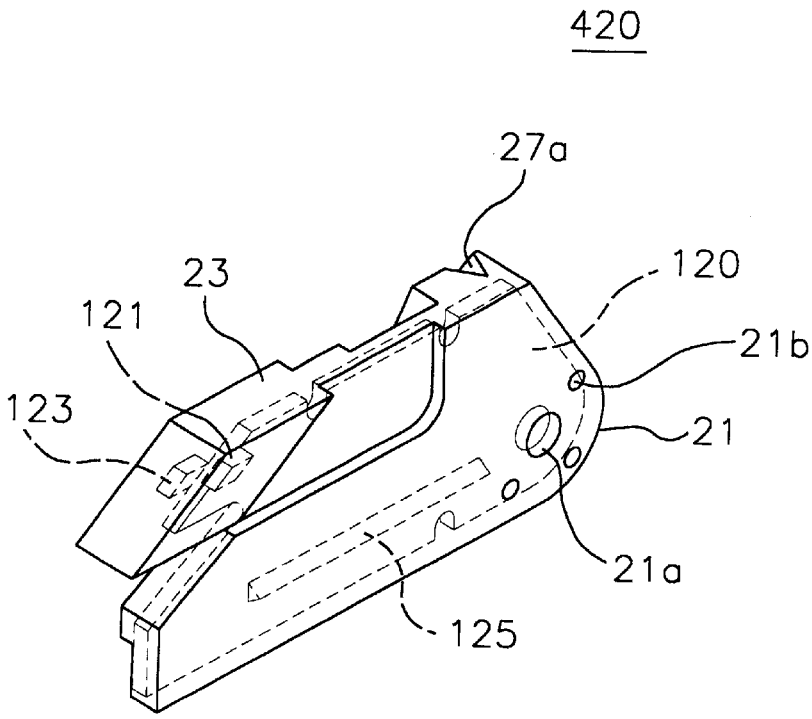
FIG. 7A is a perspective view for showing a slider according to the fourth embodiment of the present invention.
Figure 7B:
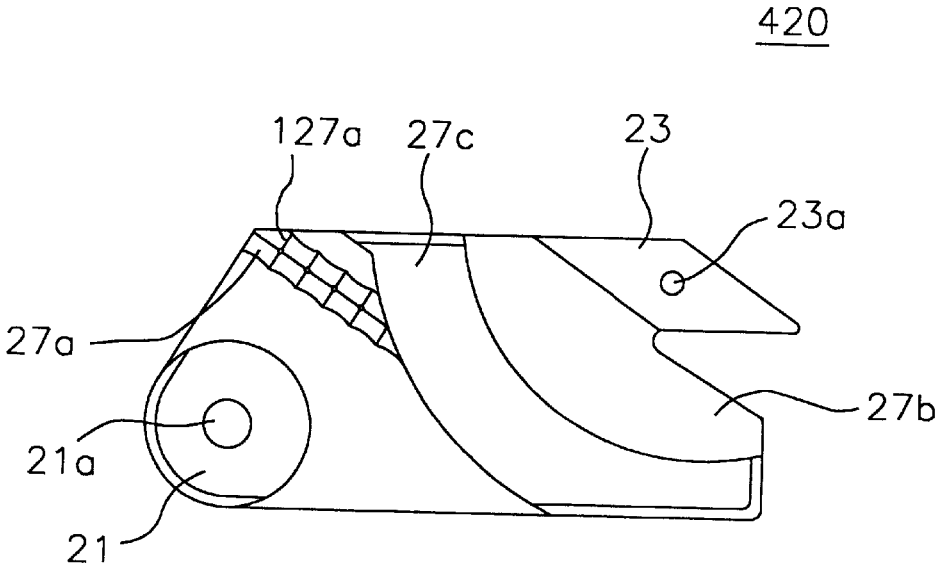
FIG. 7B is a plan view for showing the slider according to the fourth embodiment of the present invention.
Figure 8A:
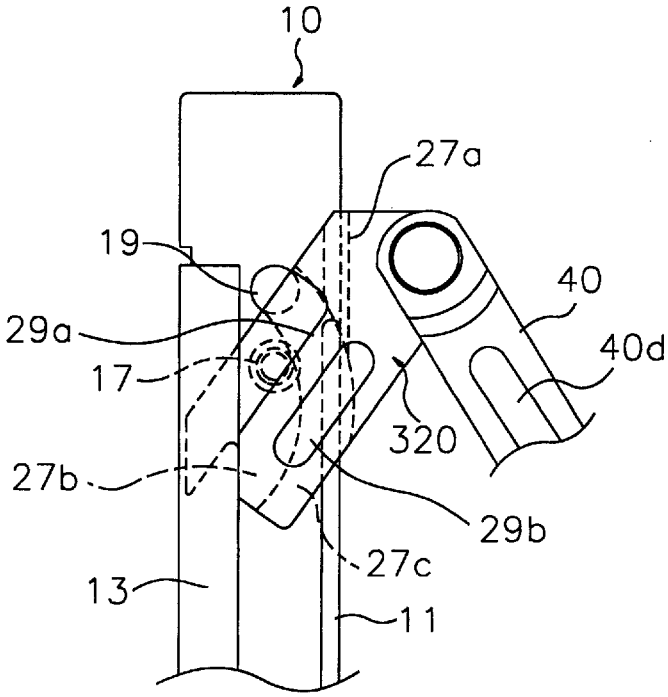
FIGS. 8A and 8B are views for showing an operational state of the opening and closing apparatus of the folding type according to the present invention.
Figure 8B:
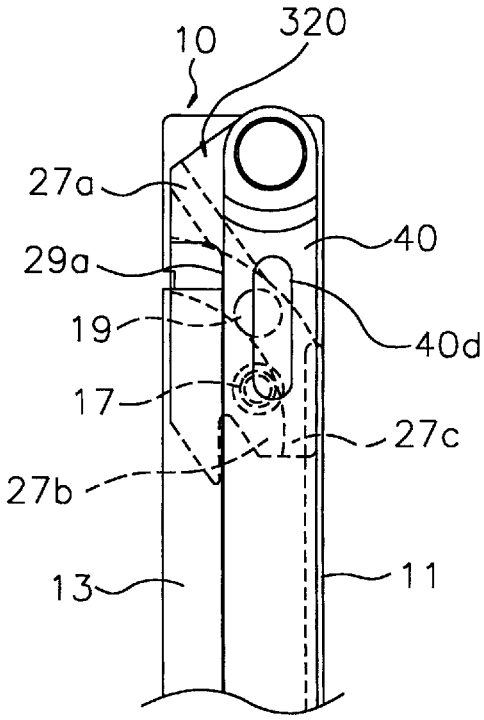

FIG. 2 is a perspective view for showing an opening and closing apparatus of the folding type according to the present invention. FIG. 3 is a perspective view for showing the established state of the opening and closing apparatus of the folding type according to the present invention. FIG. 4A is a perspective view for showing a sliding part of a slider according to the first embodiment of the present invention. FIG. 4B is a perspective view for showing a locking part of the slider according to the first embodiment of the present invention. FIG. 5A is a perspective view for showing a sliding part of a slider according to the second embodiment of the present invention. FIG. 5B is a perspective view for showing a locking part of the slider according to the second embodiment of the present invention. FIG. 6A is a perspective view for showing a sliding part of a slider according to the third embodiment of the present invention. FIG. 6B is a perspective view for showing a locking part of the slider according to the third embodiment of the present invention. FIG. 7A is a perspective view for showing a slider according to the fourth embodiment of the present invention. FIG. 7B is a plan view for showing the slider according to the fourth embodiment of the present invention. FIGS. 8A and 8B are views for showing an operational state of the opening and closing apparatus of folding type according to the present invention.

Referring to FIG. 2, the opening and closing apparatus 1 of the folding type according to the present invention includes a guiding part 10, a slider 320, a first link 30, and a second link 40.

The guiding part 10 includes a guiding protrusion 11, a guiding bend 13 and a first connecting portion 15. The guiding protrusion 11 is formed in a longitudinal direction on one side of the guiding part 10. The guiding bend 13 is formed in parallel to the guiding protrusion 11 and has a cross-sectional shape of the letter "C". On a lower side of the guiding part 13 stoppers 13*a*, 13*b* are formed which protrude toward the inside of the guiding bend 13. The first connecting portion 15 is formed on a lower side of the guiding part 10 and is connected to the first link 30. The guiding part 10 has a first fixing part 17 and the second fixing part 19. The first fixing part 17 protrudes from a face between the guiding protrusion 11 and the guiding bend 13. The second fixing part 19 protrudes at an upper side of the first fixing part 17.

The slider 320 is connected with the guiding protrusion 11 of the guiding part 10 and the guiding bend 13 and moves in the longitudinal direction of the guiding part 10. The slider 320 is preferably made of plastic.

The first link 30 includes a second connecting portion 31 and a third connecting portion 33. The second connecting portion 31 is hinged with the first connecting portion 15 of the guiding part 10 by a first rivet 81.

The second link 40 includes a link-connecting portion 41, a slider connecting portion 43, and a frame connecting portion 45. The link-connecting portion 41 is connected with the third connecting portion 33 of the first link 30 by a second rivet 83. The slider connecting portion 43 is slanted to the slider 320 side centered about the link-connecting portion 41. The frame connecting portion 45 is formed at a side opposite to the slider connecting portion 43 centered about the link-connecting portion 41. The slider connecting portion 43 is connected to a connecting hole 21*a* of the rotating part 21 formed on the slider 20 by a plastic washer 85.

As shown in FIG. 3, the opening and closing apparatus of the folding type 1 is installed on a fixed frame 60 and a movable frame 70. The guiding part 1 is secured on the fixed frame 60. The guiding protrusion 11 and the guiding bend 13 are connected to the slider 320. The second link 40 is hinged with the slider 320, the movable frame 70, and the first link 30. The first link 30 has the other side hinged with a lower side of the guiding part 10. This embodiment discloses a window case, but other embodiments are also achieved.

Referring to FIGS. 4A and 4B, the slider 20 according to the first embodiment of the present invention includes a rotating part 21, a combining part 23, a slant 25, a sliding part 27 and a locking part 29. The rotating part 21 has a connecting hole 21*a* to be hinged with the slider connecting portion 43 of the second link 40. The combining part 23 is inserted into the guiding bend 13 to combine with the guiding bend 13 and for moving along the guiding bend 13. The slant 25 is formed at one side of the combining part 23 along a slope. The sliding part 27 includes a groove 27*a*, a first leading portion 27*b* and a second leading portion 27*c*. The groove 27*a* is formed in a shape of letter "V" or letter "U" for receiving the guiding protrusion 11. The first leading portion 27*b* has a stairstep formation with the combining part 23 to receive the first fixing portion 17. The second leading portion 27*c* has a stairstep formation with the first leading portion 27*b* to receive the second fixing portion 19 and continues from the groove 27*a*. The locking part 29 is formed at a rear side of the sliding part 27 and has a stepped projection 29*a* to receive the guiding bend 13 when the slider 20 moves to a shutting position. The slider 20 is preferably made of plastic.

To describe embodiments of the present invention, the same part of the invention appearing in more than one view of the drawing will be designated by the same reference character, and the description thereof is omitted to avoid the repetition.

Referring to FIGS. 5A and 5B, a slider 220 according to the second embodiment of the present invention includes all parts of the slider 20 according to the first embodiment of the present invention. The rotating part 21 of the slider 220 according to the second embodiment of the present invention further includes at least one first friction-reducing portion 21*b*. The friction-reducing portion 21*b* is formed around the connecting hole 21*a* to reduce friction forces between the slider 220 and the second link 40 when the slider 220 cooperates with the second link 40. The combining part 23 further includes a second friction-reducing portion 23*a* for reducing friction forces between the guiding bend 13 and the combining part 23 when the combining part 23 moves by the guiding bend 13. On the wall of the groove 27*a* of the slider 220, ripples 127*a* are formed. The ripples 127*a* reduce the friction forces caused by the movement of the slider 220 along the guiding protrusion 11 of the guiding part 10 and use a path of the oil.

Referring to FIGS. 2, 3, 6A and 6B, a slider 320 according to the third embodiment of the present invention includes all parts of the slider 220 according to the second embodiment of the present invention. The locking part 29 of the slider 320 further includes a locking protrusion 29*b* protruding from the locking part 29 toward the second link 40. The locking protrusion 29*b* is formed in a dome shape. As shown in FIG. 2, the second link 40 according to the third embodiment of the present invention further includes a fixing protrusion 40*d* protruding toward the locking protrusion 29*b* to face each other. The fixing protrusion 40*d* is formed in a dome shape.

Referring to FIGS. 7A and 7B, a slider 420 according to the fourth embodiment of the present invention includes all parts of the slider 320 according to the third embodiment of the present invention and further includes a reinforcing member 120. The reinforcing member 120 is preferably made of metal. The reinforcing member 120 has a first reinforcing piece 121, a second reinforcing portion 123, and a reinforcing protrusion 125. The first reinforcing piece 121 protrudes from one face of the reinforcing member 120 facing the combining member 23 to reinforce the combining member 23 of the slider 420. The second reinforcing piece 123 protrudes from the opposite side of the first reinforcing piece 121 to reinforce the combining part 23 of the reinforcing member 120. The reinforcing protrusion 125 protrudes for fixing the reinforcing member 120 into the locking part 29 of the slider 420.

Hereinafter, the operation of the present invention will be described referring to FIGS. 2, 3, 8A and 8B.

First, when the user wants to shut the window, the user pulls the movable frame 70 toward the fixed frame 60. The second link 40 rotates in a clockwise direction centered about the link-connecting portion 41, and thus the slider 320 moves toward the first fixing part 17 along with the guiding part 10. At that time, the first link 30 rotates in counterclockwise direction centered about the first connecting portion 15. When the second leading portion 27*c* of the slider 320 receives the second fixing portion 19, the guiding protrusion 11 departs from the groove 27 as shown in FIG. 8A. Therefore, the slider 320 rotates in a counterclockwise direction centered about a connecting portion between the guiding protrusion 13 and the combining portion 23. At that time, the stepped projection 29*a* formed on the locking part 29 of the slider 320 receives an upper end of the guiding bend 12, and thus the guiding part 10, the slider 320, the first link 30 and the second link 40 are positioned one upon another. At that time, the locking protrusion 29*b* and the fixing protrusion 40*d* cause the apparatus to be in a stable closed state.

Contrarily, when the user wants to open the window, if the user pushes the movable frame 70 toward the outside, the fixing protrusion 40*d* departs from the locking protrusion 29*b*, and thus the second link 40 rotates in a counterclockwise direction centered about the slider connecting portion 43. At that time, the first link 30 rotates in a clockwise direction centered about the first connecting portion 15, and the slider 320 rotates in a clockwise direction centered about a connecting portion between the guiding bend 13 and the combining part 23. In regard to the slider 320, the first fixing portion 17 and the second fixing portion 19 separate from the first leading portion 27*b* and the second leading portion 27*c*. When the second fixing portion 19 separates from the second leading portion 27*c*, the groove 27*a* receives the guiding protrusion 11. The slider 320 continues to move itself toward the first connecting part 15 and then stops due to the stoppers 13*a*, 13*b*.

Effects of the opening and closing apparatus according to the present invention as constructed above will be described below.

The present invention opening and closing apparatus prevents the slider from joggling in the guiding part by moving the slider having the rotating part and the groove along the guiding part.

Second, the slider has a friction reducing portion formed on each of the combining part, the groove, and the rotating part, which suppresses noise due to the frictional operation between the components by putting oil into or on the frictional portion.

Third, the guiding part having the first and second fixing portions, the slider having the first and second leading portions, the locking protrusion, and the fixing protrusion, together, stably maintain the apparatus in the closed state.

Fourth, the reinforcing member having the first reinforcing piece and the second reinforcing piece is made of metal, and provides the slider with more rigidity. Further, even though the plastic slider will melt in a fire, the metal reinforcing member will not melt, thereby keeping the opening and closing apparatus together and preventing secondary accidents caused by falling of the movable frame.

While this invention has been particularly shown and described with reference to particular embodiments thereof, it will be understood by those skilled in the art that various changes in form and details may be effected therein without parting from the spirit and scope of the invention as defined by the appended claims.

What is claimed is:

1. An opening and closing apparatus of a folding type comprising:

a guiding part having a guiding protrusion formed in a longitudinal direction on one side of the guiding part, a guiding bend formed in parallel to the guiding protrusion and having a shape of a C, a fixing element extending from the guiding part near the guiding protrusion and the guiding bend, and a first connecting portion formed on a lower side of the guiding part;

a slider slidably connected with the guiding protrusion and the guiding bend for moving along the longitudinal direction of the guiding part, the slider being engagable with the fixing element and shaped to rotate while remaining engaged with the guiding bend and disengage from the guiding protrusion when the apparatus is moved into a shutting position;

a first link having a second connecting portion for being hinged with the first connecting portion and a third connecting portion formed at an opposite side from the second connecting portion; and a frame connecting part having a link-connecting portion connected with the third connecting portion, a slider connecting portion slanted to the slider side centered about the link-connecting portion, and a frame connecting portion formed at an opposite side from the slider connecting portion centered about the link-connecting portion.

2. The opening and closing apparatus of claim 1, wherein the guiding bend further comprises at least one stopper formed at a lower side of the guiding bend and protruding inside of the guiding bend.

3. The opening and closing apparatus of claim 1, wherein the fixing element comprises a first fixing portion which protrudes from a face between the guiding protrusion and the guiding bend; and a second fixing portion which protrudes at an upper side of the first fixing portion.

4. The opening and closing apparatus of claim 3, wherein the slider comprises:

a rotating part having a connecting hole to be hinged with the second connecting portion of the first link;

a combining part inserted into the guiding bend to combine with the guiding bend and for moving along the guiding bend;

a slant formed at one side of the combining part along a slope;

a sliding part having the groove for receiving the guiding protrusion, a first leading portion having a stairstep formation with the combining part to receive the first fixing portion, and a second leading portion having a stairstep formation with the first leading portion to receive the second leading portion and continues from the groove; and a locking part formed at a rear side of the sliding part and having a stepped projection to receive the guiding bend when the slider moves to a shutting position.

5. The opening and closing apparatus of claim 4, wherein the rotating part comprises at least one first friction reducing portion formed around the connecting hole to reduce friction forces between the slider and the second link when the rotating part cooperates with the second link.

6. The opening and closing apparatus of claim 4, wherein the combining part comprises a second friction reducing portion for reducing friction forces between the guiding bend and the combining part when the combining part moves by the guiding bend.

7. The opening and closing apparatus of claim 4, wherein walls of the groove are formed with ripples.

8. The opening and closing apparatus of claim 4, wherein the locking part further comprises a locking protrusion protruding from the locking part toward the second link and having a dome shape.

9. The opening and closing apparatus of claim 8, wherein the second link comprises a fixing protrusion protruding toward the locking protrusion to face each other and having a dome shape.

10. The opening and closing apparatus of claim 4, wherein the slider is made of plastic.

11. The opening and closing apparatus of claim 10, wherein the slider further comprises a reinforcing member made of metal which is inserted on the inside of the slider.

12. The opening and closing apparatus of claim 11, wherein the reinforcing member comprises:

a first reinforcing piece protruding from one face of the reinforcing member facing the combining member to reinforce the slider; and a second reinforcing piece protruding from the opposite side of the first reinforcing piece to reinforce the combining part.

13. An opening and closing apparatus of a folding type comprising:

a guiding part having a first guide formed in a longitudinal direction on one side of the guiding part, a second guide formed in parallel to the first guide, a fixing element extending from the guiding part near the first and second guides, and a first connecting portion formed on a lower side of the guiding part;

a slider slidably connected with the first and second guides for moving along the longitudinal direction of the guiding part, the slider being engagable with the fixing element and shaped to rotate while remaining engaged with the second guide and disengage from the first guide when the apparatus is moved into a shutting position;

a first link having a second connecting portion for being hinged with the first connecting portion and a third connecting portion formed at an opposite side from the second connecting portion; and a frame connecting part having a link-connecting portion connected with the third connecting portion, a slider connecting portion connected with the slider, and a frame connecting portion formed at an opposite side from the slider connecting portion.

14. The opening and closing apparatus of claim 13, wherein the second guide further comprises at least one stopper formed at a lower side of the second guide.

15. The opening and closing apparatus of claim 13, wherein the fixing element comprises a first fixing portion which protrudes from a face of the guiding part; and a second fixing portion which protrudes at an upper side of the first fixing portion.

16. The opening and closing apparatus of claim 13, wherein the slider is made of plastic.

17. The opening and closing apparatus of claim 16, wherein the slider further comprises a reinforcing member made of metal which is inserted on the inside of the slider.

18. An opening and closing apparatus of a folding type comprising:

a guiding part having a guiding protrusion formed in a longitudinal direction on one side of the guiding part, a guiding bend formed in parallel to the guiding protrusion and having a shape of a C, a first connecting portion formed on a lower side of the guiding part, a first fixing portion protruding from a face between the guiding protrusion and the guiding bend, and a second fixing portion protruding at an upper side of the first fixing portion;

a slider slidably connected with the guiding protrusion and the guiding bend for moving along the longitudinal direction of the guiding part, the slider comprising:

a rotating part having a connecting hole to be hinged with the second connecting portion of the first link;

a combining part inserted into the guiding bend to combine with the guiding bend and for moving along the guiding bend;

a slant formed at one side of the combining part along a slope;

a sliding part having a groove for receiving the guiding protrusion, a first leading portion having a stairstep formation with the combining part to receive the first fixing portion, and a second leading portion having a stairstep formation with the first leading portion to receive the second leading portion and continues from the groove; and a locking part formed at a rear side of the sliding part and having a stepped projection to receive the guiding bend when the slider moves to a shutting position;

a first link having a second connecting portion for being hinged with the first connecting portion and a third connecting portion formed at an opposite side from the second connecting portion; and a frame connecting part having a link-connecting portion connected with the third connecting portion, a slider connecting portion slanted to the slider side centered about the link-connecting portion, and a frame connecting portion formed at an opposite side from the slider connecting portion centered about the link-connecting portion.

19. The opening and closing apparatus of claim 18, wherein the guiding bend further comprises at least one stopper formed at a lower side of the guiding bend and protruding inside of the guiding bend.

20. The opening and closing apparatus of claim 18, wherein the rotating part comprises at least one first friction reducing portion formed around the connecting hole to reduce friction forces between the slider and the second link when the rotating part cooperates with the second link.

21. The opening and closing apparatus of claim 18, wherein the combining part comprises a second friction reducing portion for reducing friction forces between the guiding bend and the combining part when the combining part moves by the guiding bend.

22. The opening and closing apparatus of claim 18, wherein walls of the groove are formed with ripples.

23. The opening and closing apparatus of claim 18, wherein the locking part further comprises a locking protrusion protruding from the locking part toward the second link and having a dome shape.

24. The opening and closing apparatus of claim 23, wherein the second link comprises a fixing protrusion protruding toward the locking protrusion to face each other and having a dome shape.

25. The opening and closing apparatus of claim 18, wherein the slider is made of plastic.

26. The opening and closing apparatus of claim 25, wherein the slider further comprises a reinforcing member made of metal which is inserted on the inside of the slider.

27. The opening and closing apparatus of claim 26, wherein the reinforcing member comprises:

a first reinforcing piece protruding from one face of the reinforcing member facing the combining member to reinforce the slider; and a second reinforcing piece protruding from the opposite side of the first reinforcing piece to reinforce the combining part.

* * * * *